US007361061B2

(12) United States Patent
Kim

(10) Patent No.: US 7,361,061 B2
(45) Date of Patent: Apr. 22, 2008

(54) EAR-JACK OF PORTABLE TERMINAL

(75) Inventor: Tae-Yong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/299,680

(22) Filed: Dec. 13, 2005

(65) Prior Publication Data

US 2006/0183368 A1 Aug. 17, 2006

(30) Foreign Application Priority Data

Dec. 13, 2004 (KR) ..... 10-2004-0105114

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS

| | | | | |
|---|---|---|---|---|
| 1,565,263 | A * | 12/1925 | Denny et al. | 439/721 |
| 1,696,865 | A * | 12/1928 | Schellenger | 439/668 |
| 3,418,438 | A * | 12/1968 | Barrett | 200/51.1 |
| 4,659,167 | A * | 4/1987 | Masuda | 439/668 |
| 4,937,404 | A * | 6/1990 | Kitagawa | 200/51.09 |
| 6,149,469 | A * | 11/2000 | Kim | 439/668 |
| 6,220,899 | B1 * | 4/2001 | Suzuki | 439/675 |
| 6,270,380 | B1 * | 8/2001 | Shichida et al. | 439/669 |
| 6,394,852 | B1 * | 5/2002 | Huang | 439/669 |
| 6,524,138 | B1 * | 2/2003 | Li et al. | 439/669 |
| 6,592,408 | B2 * | 7/2003 | Ma et al. | 439/669 |
| 6,595,804 | B2 * | 7/2003 | Nagata | 439/668 |
| 6,856,046 | B1 * | 2/2005 | Scarlett et al. | 307/125 |
| 6,866,527 | B2 * | 3/2005 | Potega | 439/218 |
| 6,991,497 | B1 * | 1/2006 | Lin | 439/668 |
| 2004/0175993 | A1 * | 9/2004 | Chennakeshu | 439/668 |

FOREIGN PATENT DOCUMENTS

| | | |
|---|---|---|
| JP | 6-36255 U | 5/1994 |
| JP | 2001-217053 A | 8/2001 |
| JP | 2002-42996 A | 2/2002 |

* cited by examiner

*Primary Examiner*—Tulsidas C. Patel
*Assistant Examiner*—Vladimir Imas
(74) *Attorney, Agent, or Firm*—Birch, Stewart, Kolasch & Birch, LLP

(57) ABSTRACT

An ear-jack of a portable terminal according to an embodiment includes a body having a passage into which a plug can be inserted; a first speaker terminal disposed at the passage of the body, for electrical connection with the plug; a second speaker terminal disposed at a rear of the first speaker terminal, for electrical connection with the plug; and a microphone terminal disposed at the passage of the body such that the microphone terminal is prevented from being shorted to the second speaker terminal when the plug is inserted into the passage of the body.

9 Claims, 3 Drawing Sheets

EAR-JACK OF PORTABLE TERMINAL

The present application claims the priority benefit of Korean Patent Application No. 10-2004-105114 filed on Dec. 13, 2004 in Republic of Korea, the entire contents of which are herein fully incorporated by reference.

BACKGROUND OF THE INVENTION

1. Field of the Invention

The present invention relates to an ear-jack, and more particularly, to an ear-jack of a portable terminal capable of preventing the terminal from malfunctioning when a plug of an ear-phone is inserted into the ear-jack.

2. Description of the Background Art

FIG. 1 is a cross-sectional view showing an ear-jack in accordance with a background art, and FIG. 2 is a cross-sectional view showing a state that a plug of an ear-phone is completely inserted into the ear-jack of FIG. 1 according to the background art.

As shown in FIGS. 1 and 2, the ear-jack in accordance with the background art includes: a body 106 fixed to a portable terminal such as a mobile phone and having at the center portion thereof a passage 104 into which a plug 102 of an ear-phone can be inserted; and a plurality of connection terminals 130, 132, 134, 136 mounted on the body 106 and connected with the plug 102 when the plug 102 is inserted into the body 106, for transferring electrical signals of the portable terminal to the ear-phone or transferring electrical signals of the ear-phone to the portable terminal.

Mounting holes 108, 110, 112 and 114 installed to respectively allow the connection terminals 130, 132, 134, and 136 to be exposed to the inside of the passage 104 are formed at the passage 104 of the body 106. These mounting holes are formed at regular intervals in turn from an entrance of the passage 104 in the following order: the first mounting hole 108, the second mounting hole 110, the third mounting hole 112 and the fourth mounting hole 114. In addition, a plug detecting sensor 116 is installed at the body 106 such that the plug detecting sensor 116 detects whether or not the plug 102 is inserted into the body 106, and transfers signals to a CPU of the portable terminal when it detects that the plug 102 has been inserted into the body 106.

A first connection portion 120, a second connection portion 122, a third connection portion 124 and a fourth connection portion 126 are formed in turn at an outer circumferential surface of the plug 102 of the ear-phone at regular intervals, and a groove 128 is formed at the fourth connection portion 126. These connection portions are electrically insulated from each other, as indicated by shades. After the plug 102 of the ear-phone is inserted into the passage 104 of the body 106, one of the connection terminals (e.g., the connection terminal 136) elastically abuts against the groove 128, thereby preventing the plug 102 from coming out of the body 106.

The connection terminals includes: a ground terminal 130 elastically mounted at the body 106, disposed at the first mounting hole 108 and connected with the first connection portion 120 of the plug 102, for grounding the plug 102; a first speaker terminal 132 disposed at the second mounting hole 110 of the body 106 and connected with the second connection portion 122 of the plug 102, for transferring audio signals to the right speaker of the ear-phone; a second speaker terminal 134 disposed at the third mounting hole 112 of the body 106 and connected with the third connection portion 124 of the plug 102, for transferring audio signals to the left speaker of the ear-phone; and a microphone terminal 136 disposed at the fourth mounting hole 114 of the body 106 and connected with the fourth connection portion 126 of the plug 102, for transferring audio signals generated from the microphone of the ear-phone to the portable terminal such as the CPU of the portable terminal.

Here, when the plug 102 is not inserted into the body 106, the microphone terminal 136 is shorted to the plug detecting sensor 116 installed at the body 106 and therefore 0V (zero volt) is applied to the plug detecting sensor 116. Then, if the plug 102 is inserted into the body 106, the microphone terminal 136 is separated from the plug detecting sensor 116 and at this time the output voltage of the plug detecting sensor 116 increases to about 2.8V, thus supplying the CPU with signals indicating that the ear-phone has been electrically connected to the terminal.

In addition, when the plug 102 is completely inserted into the passage 104 of the body 106, the microphone terminal 136 elastically comes in contact with the groove 128 formed at the plug 102, thereby preventing the plug 102 from coming out of the passage 104 of the body 106.

An operation of the ear-jack of the portable terminal in accordance with the background art having such a construction will be described as follows.

Firstly, when the plug 102 of the ear-phone is not inserted into the passage 104 of the body 106, the microphone terminal 136 and the plug detecting sensor 116 are shorted to each other. Thus, the CPU recognizes that the ear-phone is not inserted into the portable terminal.

In such a state, when the plug 102 of the ear-phone is inserted into the passage 104 of the body 106, the first connection portion 120 and the ground terminal 130 are connected to each other, thereby grounding the plug 102. Then, the second connection portion 122 of the plug 102 and the first speaker terminal 132 are connected to each other such that audio signals generated from the portable terminal are transferred to the right speaker of the ear-phone. The third connection portion 124 of the plug 102 is connected with the second speaker terminal 134, thereby transferring audio signals generated from the portable terminal to the left speaker of the ear-phone. The fourth connection portion 126 of the plug 102 is connected with the microphone terminal 136, so that audio signals generated from the microphone of the ear-phone are transferred to the portable terminal.

At this time, as the microphone terminal 136 is separated from the plug detecting sensor 116 by means of the fourth connection portion of the plug 104, if a voltage of approximately 2.8V is generated at the plug detecting sensor 116 and electrical signals are transferred to the CPU of the portable terminal, the CPU recognizes that the ear-phone is inserted and connected to the portable terminal.

However, as shown in FIG. 3, in the ear-jack of the portable terminal having the construction and operation as discussed above, in the process of inserting the plug 102 of the ear-phone into the passage 104 of the body 106, the fourth connection portion 126 of the plug 102 first comes in contact with the microphone terminal 136 and as a result, the microphone terminal 136 is separated from the plug detecting sensor 116 in a state that the plug 102 is not completely inserted into the passage of the body 106. Thus, there is a problem that the portable terminal malfunctions may occur because signals indicating that the ear-phone has been inserted and connected to the portable terminal are supplied to the CPU of the portable terminal before the plug 102 is completely inserted in the passage 104 of the body 106.

In addition, in the process of inserting the plug 102 fully into the passage 104, the microphone terminal 136 and the second speaker terminal 134 come in contact with the fourth connection portion 126 of the plug 102 at the same time as shown in FIG. 3, and thus the microphone terminal 136 and the second speaker terminal 134 are shorted. Accordingly, a malfunction that a call is connected when the plug 102 is inserted into the passage of the body 106 occurs because the CPU of the portable terminal recognizes that a call button is pressed.

SUMMARY OF THE INVENTION

Therefore, an object of the present invention is to provide an earjack of a portable terminal which can prevent the terminal from malfunctioning when the plug is inserted into a body by preventing a microphone terminal and a second speaker from being shorted by the plug when the plug is inserted into the ear-jack.

Another object of the present invention is to provide a portable terminal having an ear-jack, which address the limitations and disadvantages associated with the background art.

To achieve these and other advantages and in accordance with the purpose of the present invention, as embodied and broadly described herein, there is provided according to an embodiment an ear-jack of a portable terminal, comprising: a body having a passage into which a plug can be inserted; a first speaker terminal disposed at the passage of the body, for electrical connection with the plug; a second speaker terminal disposed at a rear of the first speaker terminal, for electrical connection with the plug; and a microphone terminal disposed at the passage of the body such that the microphone terminal is prevented from being shorted to the second speaker terminal when the plug is inserted into the passage of the body.

According to another aspect, the present invention provides an ear-jack of a portable terminal, comprising: a body having a passage into which a plug can be inserted; a connection terminal connectable with a first connection portion of the plug and disposed at the passage; a first speaker terminal disposed at a distance from the connection terminal and connectable with a second connection portion of the plug; a second speaker disposed at a distance from the first speaker terminal and connectable with a third connection portion of the plug; a microphone terminal disposed at a distance from the second speaker terminal and connectable with a fourth connection portion of the plug; and a support member mounted at one side of the passage and elastically supported by an outer surface of the plug when the plug is completely inserted into the passage of the body.

According to another aspect, the present invention provides an ear-jack device for a portable terminal, the device comprising: a body having a passage to receive a plug therein; a signal terminal disposed at the body, and configured to selectively make an electrical connection with a portion of the plug; a plug detecting sensor selectively connected to the signal terminal; and a support member disposed at the body, and configured to contact the plug before the signal terminal contacts the plug when the plug is inserted into the passage, whereby the plug detecting sensor detects the plug when the plug is fully inserted into the passage.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of an ear-jack of a portable terminal in accordance with the present invention, examples of which are illustrated in the accompanying drawings.

There can be a plurality of embodiments of the earjack of the portable terminal in accordance with the present invention, of which the preferred embodiments will now be described.

Figure 1:
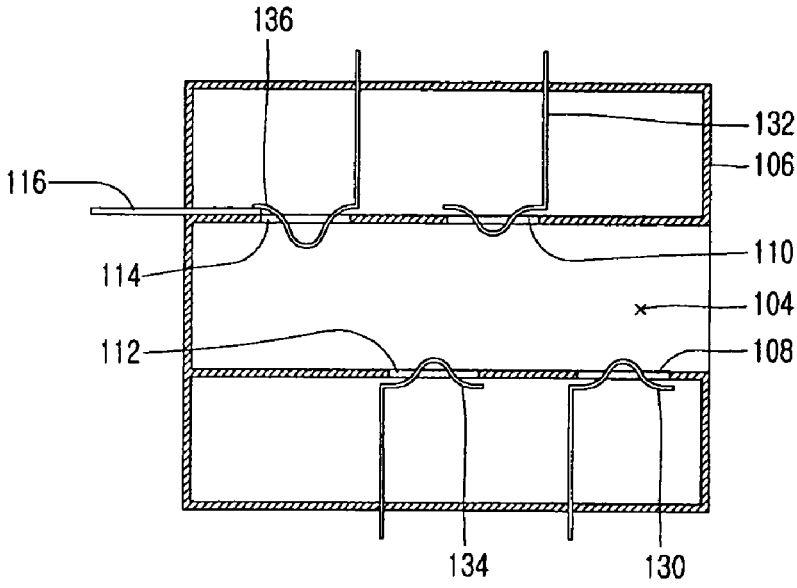
FIG. 1 BACKGROUND ART
FIG. 1 is a cross-sectional view showing an ear-jack in accordance with a background art.
Figure 2:
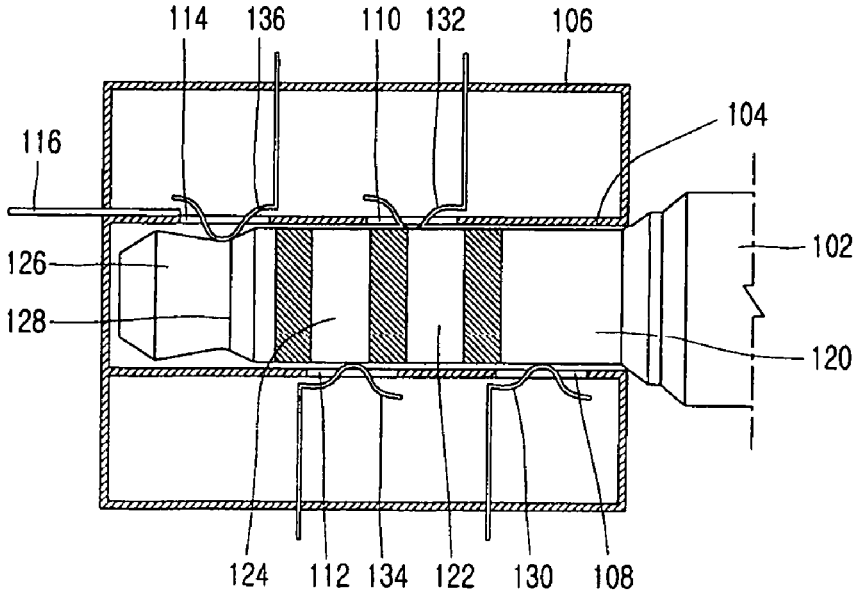
FIG. 2 BACKGROUND ART
FIG. 2 is a cross-sectional view showing a state that a plug of an ear-phone is completely inserted into the ear-jack of FIG. 1 according to the background art.
Figure 3:
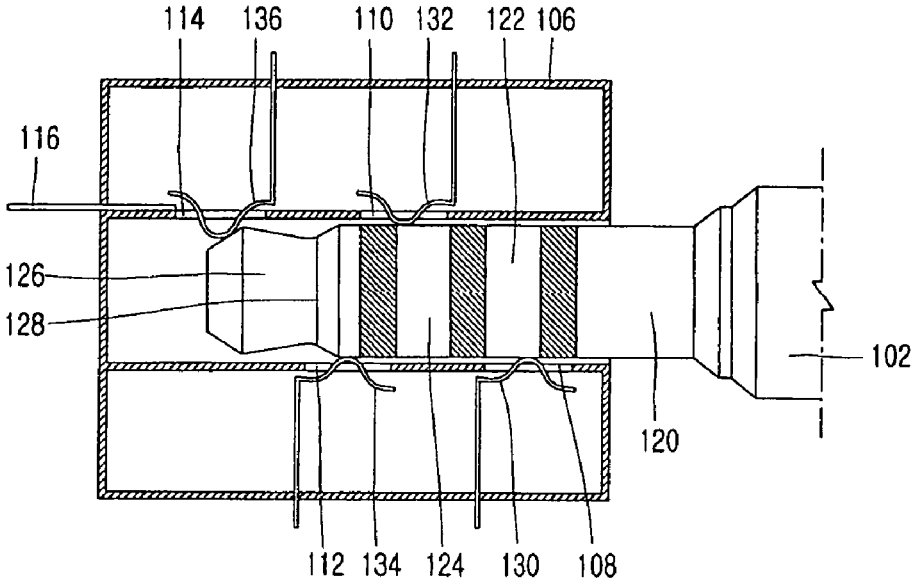
FIG. 3 BACKGROUND ART
FIG. 3 is a cross-sectional view showing a state that approximately two-thirds of the plug of the ear-phone is inserted into the ear-jack of FIG. 1 in accordance with the background art.
Figure 4:
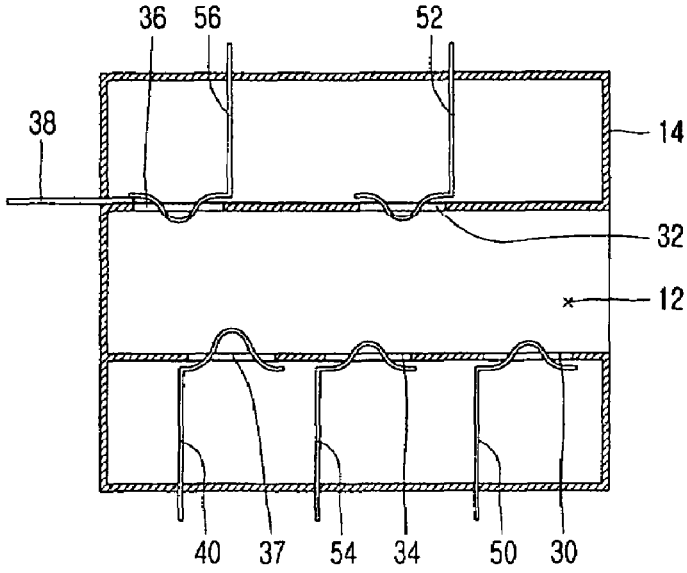
FIG. 4 is a cross-sectional view showing an earjack of a portable terminal in accordance with an embodiment of the present invention.
Figure 5:
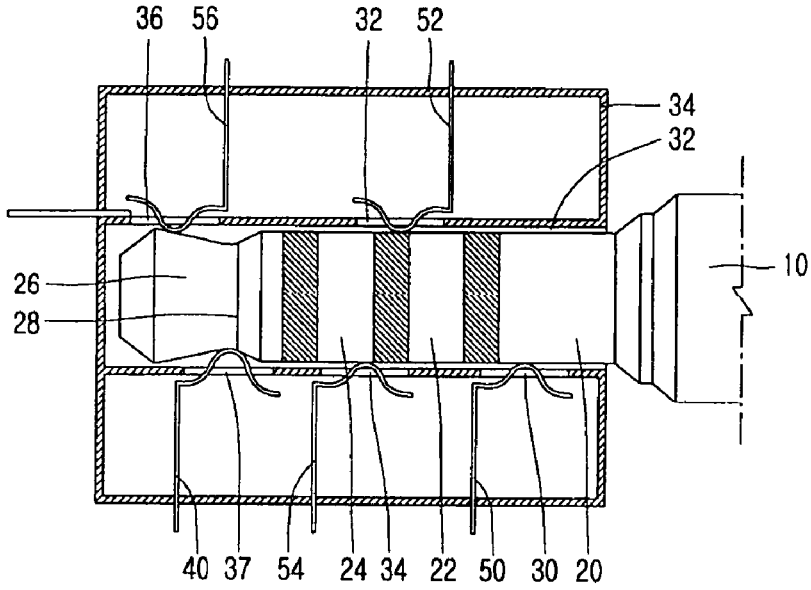
FIG. 5 is a cross-sectional view showing a state that a plug of an ear-phone is inserted into the ear-jack of the portable terminal of FIG. 4 in accordance with the present invention.

FIG. 4 is a cross-sectional view showing an earjack of a portable terminal in accordance with an embodiment of the present invention, and FIG. 5 is a cross-sectional view showing a state that a plug is inserted into the ear-jack of the portable terminal of FIG. 4 in accordance with an embodiment of the present invention.

The ear-jack of the portable terminal includes: a body 14 fixed to the portable terminal and having at the center portion thereof a passage 12 into which a plug 10 of an ear-phone or the like is inserted; and a plurality of connection terminals 50, 52, 54 and 56 mounted on the body 14 and electrically connected with the plug 10 when the plug 10 is inserted into the passage 12, for transferring electrical signals of the portable terminal to the ear-phone or transferring electrical signals of the ear-phone to the portable terminal; and a support member 40 disposed at the body 14. All the components of the ear-jack are operatively structured.

A plurality of connection portions are formed in turn at an outer circumferential surface of the plug 10 and are connected with the connection terminals, so that the electric signals are supplied. That is, the connection portions include: a first connection portion 20 functioning as a ground; a second connection portion 22 to be connected to the right (or left) speaker of the ear-phone; a third connection portion 24 to be connected to the left (or right) speaker of the ear-phone; and a fourth connection portion 26 to be connected to the microphone of the ear-phone. Here, a groove 28 which prevents the plug 10 from being released from the body 14 is formed at the fourth connection portion 26. The support member 40 mounted on the body 14 is configured to elastically come in contact with the fourth connection portion 26 initially and then to elastically abut against the groove 28.

Mounting holes installed to allow the connection terminals 50, 52, 54 and 56 to be exposed to the inside of the passage 12 are formed at the passage 12 of the body 14. These mounting holes are formed in turn from an entrance of the passage 12 as follows: a first mounting hole 30, a second mounting hole 32, a third mounting hole 34 and a fourth mounting hole 36. Also a fifth mounting hole 37 is provided to receive the support member 40 therein. In addition, a plug detecting sensor 38 is installed at the body 14 such that the plug detecting sensor 38 detects whether or not the plug 10 is inserted into the passage 12, and transfers signals to a CPU of the portable terminal when the plug 10 is inserted into the passage 12.

The connection terminals 50, 52, 54 and 56 are formed with materials having a certain degree of elasticity and elastically come in contact with the connection portions of the plug. These connection terminals include: a ground terminal 50 disposed at the first mounting hole 30 and connected with the first connection portion 20 of the plug 10, for grounding the plug 10; a first speaker terminal 52 disposed at the second mounting hole 32 and connected with the second connection portion 22 of the plug 10, for transferring audio signals to the right (or left) speaker of the ear-phone; a second speaker terminal 54 disposed at the third mounting hole 34 and connected with the third connection portion 24 of the plug 10, for transferring audio signals to the left (or right) speaker of the ear-phone; and a microphone terminal 56 disposed at the fourth mounting hole 36 and connected with the fourth connection portion 26 of the plug 10, for transferring audio signals generated from the microphone of the ear-phone to the portable terminal such as the CPU of the portable terminal.

Since the microphone terminal 56 is shorted to the plug detecting sensor 38 installed at the body 14 when the plug 10 is not inserted into the body 14, a voltage of 0V (zero volt) is applied to the plug detecting sensor 38. At this time, the CPU of the portable terminal recognizes that the plug 10 is not inserted into the body 14.

And, when the plug 10 is inserted into the body 14, the microphone terminal 56 is separated from the plug detecting sensor 36 by means of the plug 10. At this time, if a voltage of approximately 2.8V is generated at the plug detecting sensor 38 and electrical signals are supplied to the CPU of the portable terminal, the CPU recognizes that the plug 10 is inserted into the body 14.

Figure 6:
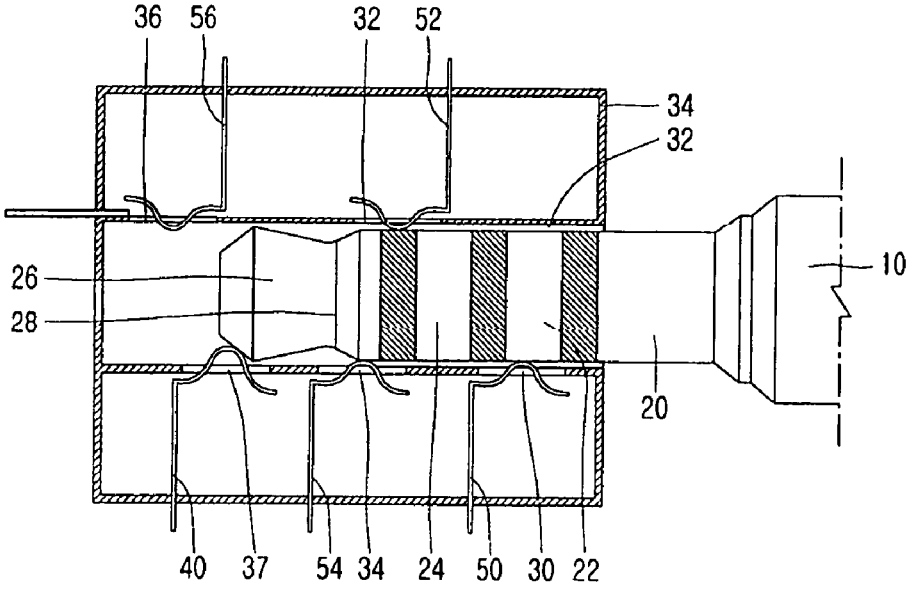
FIG. 6 is a cross-sectional view showing a state that two-thirds of the ear-phone is inserted into the ear-jack of the portable terminal of FIG. 4 in accordance with the present invention.

As shown in FIG. 6, when approximately two-thirds (or the like) of the plug 10 is inserted into the body 14 and the fourth connection portion 26 of the plug 10 is connected with the second speaker terminal 54, the microphone terminal 56 is installed at a position such that the microphone terminal 56 would not come in contact with the plug 10. That is, the microphone terminal 56 is disposed rearward in comparison to the microphone terminal 136 which has been described in the background art, whereby the fourth connection portion 26 of the plug 10 does not come in contact with the second speaker terminal 54 and the microphone terminal 56 at the same time. Thus the problem of short-circuiting between the microphone terminal 136 and the second speaker terminal 54 in the background art will not occur and is effectively addressed in the present invention.

Moreover, since the plug 10 does not come in contact with the microphone terminal 56 even when approximately two-thirds of the plug 10 is inserted into the body 14, the microphone terminal 56 remains shorted to the plug detecting sensor 38 during the ear-phone plug insertion process.

In such a state, as shown in FIG. 5, in case that the plug 10 is completely inserted into the body 14, the microphone terminal 56 is in contact with the fourth connection portion 26 of the plug 10 and is separated from the plug detecting sensor 38 to accurately reflect a complete insertion of the plug 10 into the body 14.

Moreover, the support member 40 is used to prevent the plug 10 from coming out of the body 14 since the support member 40 abuts elastically against the groove 28 once the plug 10 is fully inserted into the body 14. Particularly, disposed between the second speaker terminal 54 and the microphone terminal 56, the support member 40 is elastically inserted into the groove 28 of the plug 10 if the plug 10 is completely inserted into the body, thereby preventing the plug 10 from coming out of the body 14. Preferably, such a support member 28 is formed as a type of leaf spring having its own elasticity.

An operation of the earjack of the portable terminal of FIG. 4 in accordance with an embodiment of the present invention will be described as follows.

Firstly, if the plug 10 of the ear-phone is not inserted into the ear-jack of the portable terminal, the microphone terminal 56 and the plug detecting sensor 38 are shorted to each other and therefore a voltage of 0V flows in the plug detecting sensor 38. Thus, the CPU of the portable terminal recognizes that the ear-phone is not inserted and is not connected to the ear-jack.

When the plug 10 is inserted into the passage 12 of the body 14, the first connection portion 20 of the plug 10 comes in contact with the ground terminal 50, whereby the plug 10 is grounded. The second connection portion 22 of the plug 10 is connected with the first speaker terminal 52, thereby transferring audio signals to the right speaker. The third connection portion 24 of the plug 10 is connected with the second speaker terminal 54, thereby transferring audio signals to the left speaker. The fourth connection portion 26 is connected with the microphone terminal 56, thereby transferring audio signals generated from the microphone to the portable terminal such as the CPU of the portable terminal.

At this time, the support member 40 is elastically supported at the groove 28 formed at the fourth connection portion 26, thereby preventing the plug 10 from coming out of the body 14.

If approximately two-thirds of the plug 10 is inserted into the body 14 during such an operation, as shown in FIG. 6, the second speaker terminal 54 is in contact with the fourth connection portion 26 of the plug 10, but the microphone terminal 56 is not in contact with the fourth connection portion 26. Accordingly, a malfunction of the portable terminal can be prevented because the second speaker terminal 54 and the microphone terminal 56 are prevented from being shorted by the plug and thus the present invention effectively addresses one of the limitations associated with the background art.

In the preferred embodiments, the portable terminal can be a mobile terminal such as a mobile phone, a PDA, an MP3 player, etc. In fact, the portable terminal can be any device that requires an electrical connection between an earjack of the device and an ear-phone for. e.g., signal communication.

The ear-jack of the portable terminal in accordance with the preferred embodiments of the present invention can prevent a malfunction of the portable terminal by preventing the microphone terminal and the second speaker terminal from being shorted through the fourth connection portion of the plug when the plug is inserted into the passage of the body. This is achieved in one embodiment by installing the microphone terminal inclined toward the rear portion of the ear-jack.

In addition, when the plug is completely inserted into the passage of the body of the ear-jack, the plug can be prevented from coming out of the body. This is achieved in one embodiment by providing a support member, which is installed at the body and elastically fits in the groove (or groove area) formed at the plug.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An ear-jack device for a portable terminal, the device comprising:

a body having a passage to receive a plug therein;

a signal terminal disposed at the body, and configured to selectively make an electrical connection with a portion of the plug;

a plug detecting sensor selectively connected to the signal terminal; and a support member disposed at the body, and configured to contact the plug before the signal terminal contacts the plug when the plug is inserted into the passage, whereby the plug detecting sensor detects the plug when the plug is fully inserted into the passage, wherein the support member is disposed and configured to elastically engage within a groove of the plug to limit a movement of the plug within the passage.

2. The device of claim 1, wherein the plug detecting sensor is separated from the signal terminal when the plug is fully inserted into the passage.

3. The device of claim 1, further comprising:

first and second speaker terminals disposed at the body to electrically and respectively connect with first and second portions of the plug.

4. The device of claim 3, further comprising:

a ground terminal disposed at the passage of the body, for electrical connection with another portion of the plug.

5. The device of claim 1, wherein the signal terminal and the support member are disposed at opposite sides of the passage.

6. The device of claim 1, wherein the support member includes a leaf spring.

7. An ear-jack of a portable terminal, comprising:

a body having a passage into which a plug can be inserted;

a first speaker terminal disposed at the passage of the body, for electrical connection with the plug;

a second speaker terminal disposed at a rear of the first speaker terminal, for electrical connection with the plug;

a microphone terminal disposed at the passage of the body such that the microphone terminal is prevented from being shorted to the second speaker terminal when the plug is inserted into the passage of the body; and a support member disposed at the passage of the body and configured to contact a front area of the plug before the microphone terminal contacts the front area, when the plug is inserted into the passage, wherein the microphone terminal is disposed at a predetermined distance from the second speaker terminal, so that the microphone terminal and the second speaker terminal do not come in contact with a connection portion of the plug at the same time, when the plug is inserted into the passage, and wherein the support member is disposed and configured to elastically engage within a groove of the plug to limit a movement of the plug within the passage.

8. An ear-jack of a portable terminal, comprising:

a body having a passage into which a plug can be inserted;

a connection terminal connectable with a first connection portion of the plug and disposed at the passage;

a first speaker terminal disposed at a distance from the connection terminal and connectable with a second connection portion of the plug;

a second speaker terminal disposed at a distance from the first speaker terminal and connectable with a third connection portion of the plug;

a microphone terminal disposed at a distance from the second speaker terminal and connectable with a fourth connection portion of the plug; and a support member mounted at one side of the passage and elastically supported by an outer surface of the plug when the plug is completely inserted into the passage of the body, wherein the microphone terminal is disposed at a predetermined distance from the second speaker terminal, so that the microphone terminal and the second speaker terminal do not come in contact with the fourth connection portion of the plug at the same time, when the plug is inserted into the passage of the terminal, and wherein the support member is disposed and configured to elastically engage within a groove of the plug to limit a movement of the plug within the passage.

9. The device of claim 3, wherein the support member projects further into the passage than the first and second speaker terminals.

* * * * *